US005816074A

United States Patent [19]

Kim

[11] Patent Number: 5,816,074

[45] Date of Patent: Oct. 6, 1998

[54] BALANCING DEVICE FOR A DRUM WASHING MACHINE

[75] Inventor: Jin-Soo Kim, Suwon, Rep. of Korea

[73] Assignee: Samsung Electronics Co., Ltd., Suwon, Rep. of Korea

[21] Appl. No.: 861,569

[22] Filed: May 22, 1997

[30] Foreign Application Priority Data

May 30, 1996 [KR] Rep. of Korea ..... 1996 13850

[51] Int. Cl.[6] ..... D06F 37/22

[52] U.S. Cl. ..... 68/23.2; 74/573 R

[58] Field of Search ..... 68/23.2; 210/144, 210/363, 364; 74/573 F, 573 R

[56] References Cited

U.S. PATENT DOCUMENTS

| | | | |
|---|---|---|---|
| 2,836,046 | 5/1958 | Smith | 210/363 X |
| 2,984,094 | 5/1961 | Belaieff | 68/23.2 |
| 3,800,622 | 4/1974 | Stelwagen et al. | 210/363 X |
| 5,115,651 | 5/1992 | Nukaga et al. | 210/363 X |
| 5,460,017 | 10/1995 | Taylor | 68/23.2 |

*Primary Examiner*—Philip R. Coe

*Attorney, Agent, or Firm*—Burns, Doane, Swecker & Mathis, L.L.P.

[57] ABSTRACT

A balancing-device for a drum washing machine is disclosed, which includes a spin basket formed of front and rear panels connected with each other by a side panel; lifters provided to the side panel protruding to the inside of the spin basket; a plate member joined to each of the front and rear panels; annular races shaped from grooves formed by the attachment of either of the front panel or the rear panel to the plate member; and a plurality of balls seated in the races. The races are formed in a manner that allows the areas of the front and rear panels that contact the lifters to be planar, thus facilitating the construction of the spin basket.

2 Claims, 3 Drawing Sheets

BALANCING DEVICE FOR A DRUM WASHING MACHINE

BACKGROUND OF THE INVENTION (1) Field of the Invention

The present invention generally relates to a balancing device for a drum washing machine. More particularly, it relates to a balancing device for a drum washing machine realized as annular-shaped races whose side, contacting the washing machine's spin basket, is flat so as to facilitate installation of another components.

(2) Description of the Prior Art

A conventional drum washing machine is an electronic appliance that washes clothes utilizing the suds produced by the rotation of its drum-type spin basket. With the conventional drum washing machine, washing, rinsing and hydro-extracting tasks are automatically carried out according to a prescribed program. After the washing and rinsing of the clothes, excess water is removed from the clothes by centrifugal force created by the spin basket rotating at high speeds during the hydro-extracting process. Because abnormal vibrations and noise may be produced by the uneven distribution of the clothes in the spin basket during the hydro-extracting process, a balancing device is essential for the smooth operation of a drum washing machine.

FIG. 3 is a perspective view of a conventional drum washing machine equipped with a balancing device.

Referring to FIG. 3, the drum washing machine includes a housing 1, a tub 2 suspended by suspension springs 4*a* and shock-absorbing members 4*b* in the housing 1, and a spin basket 3 rotatably installed in the tub 2. The spin basket 3 is rotated by an electric motor 5, which is installed on the bottom of the housing 1, by means of a belt (not illustrated). The spin basket 3 has a plurality of small holes 3*a* uniformly formed on its surface, and a plurality of inward-protruding lifters 3*b* spaced a predetermined distance away from each other. Water that is removed from clothes in the spin basket 3 by centrifugal force drains into the tub 2 through the small holes 7, and the lifters 8 agitate the laundry and water created during the rotation of the spin basket 3, to thereby create suds which clean the clothes.

In order to prevent the generation of vibrations during the washing/hydro-extracting process, counterweights, each of predetermined weight, are attached to the tub 2. An 11.4 kg front counterweight 6*a* is provided to the front of the tub 2, and a 12.2 kg upper counterweight 6*b* is mounted on the top surface of the tub 2. These counterweights 6*a* and 6*b* are made from cast iron and are joined to the tub 2 by bolts 7.

Such a conventional balancing device does not fundamentally prevent the vibrations created by unevenly distributed laundry in the washing machine, but rather only restrains the vibrations with the counterweights attached to the tub, and therefore has inferior balancing characteristics. Moreover, the conventional balancing device reduces the vibration after it has already been transmitted to the tub, and is so incapable of controlling the imbalance in the initial stage of its creation.

SUMMARY OF THE INVENTION

The present invention concerns a balancing device for a drum washing machine that can obviate the above-described problems and disadvantages of the conventional art.

It is an objective of the present invention to provide a balancing device for a drum washing machine for dynamically counteracting an imbalance, which is created by laundry being unevenly distributed within the washing machine's spin basket during rotation, in the initial stage of its creation.

It is another objective of the present invention to provide a balancing device with races, the sides of which that contact the washing machine's spin basket are flat so as to facilitate the installation of lifters.

In order to obtain the aforementioned objectives of the present invention, there is disclosed a balancing device for a drum washing machine, which includes: a rotatable spin basket constructed of front and rear panels connected with each other by a side panel; lifters provided to the side panel that protrude to the inside of the spin basket, each having one end contacting the front panel and the other end contacting the rear panel; plate members joined to the front and rear panels; annular races, concentric with the spin basket, formed by outward-protruding outer grooves which are made by the attachment of either of the flat front panel or the flat rear panel to the plate member; and a plurality of balls seated in the races. The number of the races is at least two, and one of them is provided to the outside of each of the lifters.

DETAILED DESCRIPTION OF THE PREFERRED EMBODIMENTS

The preferred embodiments of the present invention will now be described in detail with reference to the accompanying drawings.

Figure 1:
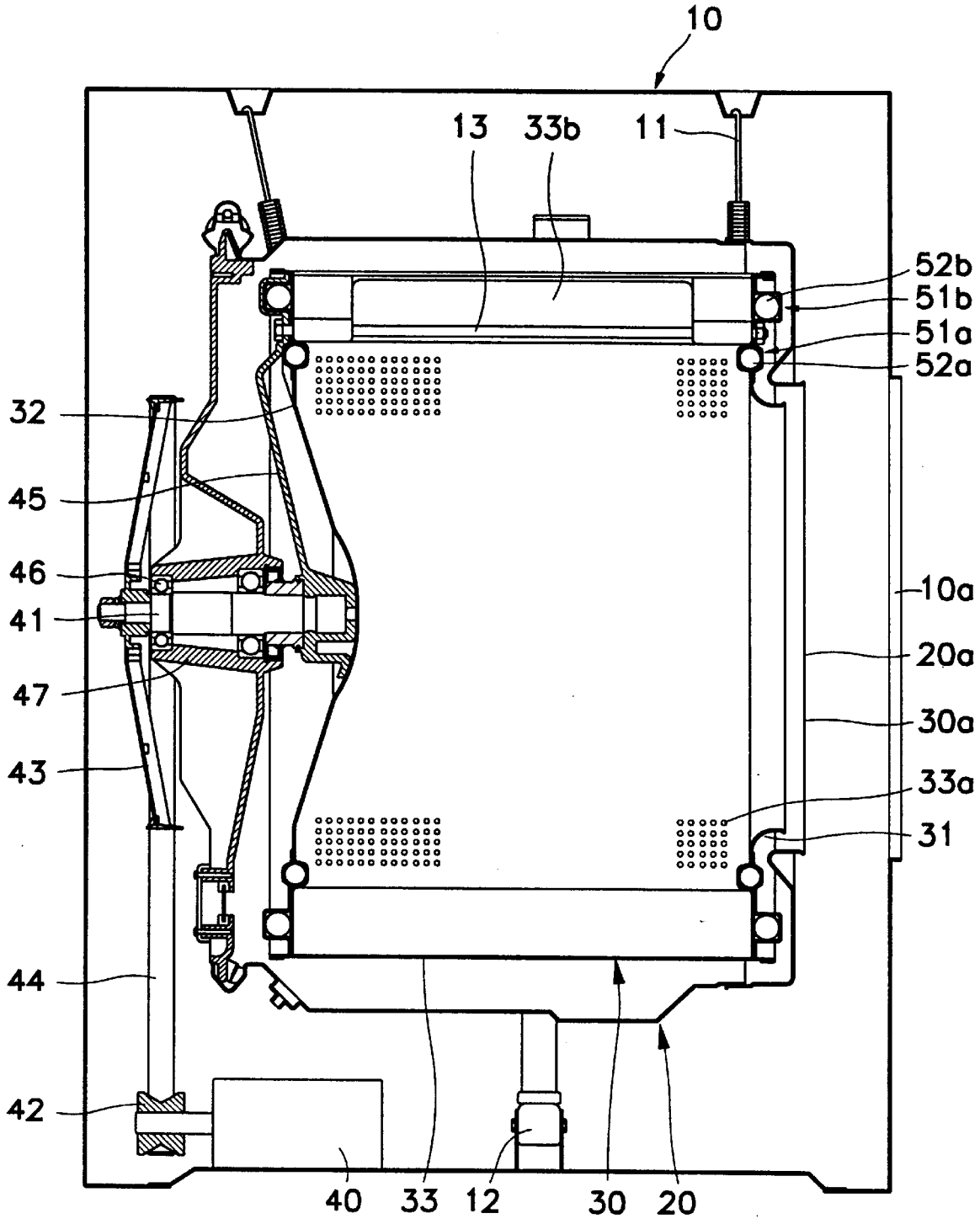
FIG. 1 is a sectional view of a drum washing machine with a balancing device in accordance with the present invention.

FIG. 1 is a sectional view for showing the overall construction of a drum washing machine equipped with a balancing device in accordance with the present invention.

As shown in FIG. 1, the drum washing machine includes a housing 10, a tub 20 suspended in the housing 10, a spin basket 30 rotatably installed within the tub 20, and an electric motor 40 mounted below the tub 20 that rotates the spin basket 30. The tub 20 is suspended by four springs 11 arranged on four sides of the housing 10, and a pair of shock absorbing arms 12 are provided under the tub 20.

The tub 20 and spin basket 30 are installed parallel to the ground rather than upright, and openings 10*a*, 20*a* and 30*a* are formed on the front of the housing 10, a predetermined spot of the tub 20 corresponding to the front of the housing 10, and a corresponding of the spin basket 30, respectively, so that laundry can be put into or taken out of the spin basket 30 therethrough.

The spin basket 30, rotatably installed within the tub 20, consists of a cylindrically-shaped side panel 33, and front and rear panels 31 and 32 respectively joined to the front and back of the side panel 33. A plurality of holes 33*a* are uniformly formed in the side panel 33, and three lifters 33*b* are formed on the side panel 33 protruding inward in the form of a "V", and are spaced 120° from each other. The lifters 33*b* raise and drop laundry to agitate it during washing. The small holes 33*a* allow water to flow freely between the tub 20 and the spin basket 30, and let water, removed from laundry during the hydro-extracting process, drain into the tub 20.

The rotating force of the electric motor 40 is transmitted to the spin basket 30 through a shaft 41 which is connected to the rear panel 32. The shaft 41, horizontally supported, extends from the rear panel 32 to the rear of the tub 20. A first pulley 42 is connected to the electric motor 40, and a second pulley 43 is connected to the shaft 41. A belt 44 is placed between the first and second pulleys 42 and 43, and a flange 45 is provided to the rear panel 32 connected with the shaft 41. A pair of bearings 46 are installed between the shaft 41 and the tub 20 so as to support the shaft 41. These bearings 46 are positioned in a bearing housing 47.

The spin basket 30 has a pair of balancing devices each provided to the front and rear panels 31 and 32 to remove the vibrations and imbalances created during rotation. The balancing devices are realized as annular races 51*a* and 51*b* that are concentrically formed on inner and outer parts of the front and rear panels 31 and 32, and a plurality of balls 52*a* and 52*b* (which serve as counterweights) that are seated in the races 51*a* and 51*b*. The inner race 51*a* and the outer race 51*b* protrude inward and outward, respectively. The inner race 51*a* and the outer race 51*b* are fitted to each other by welding to form a seal. The races 51*a* and 51*b* contain an oil of a predetermined amount to allow the balls 52*a* and 52*b* to move freely.

The balancing device of the present invention will be more fully described as follows.

The races 51*a* and 51*b*, provided to the front panel 31 and rear panel 32, are formed symmetrically, and the structure of the races 51*a* and 51*b* on the front panel 31 will be described by way of example.

Figure 2:
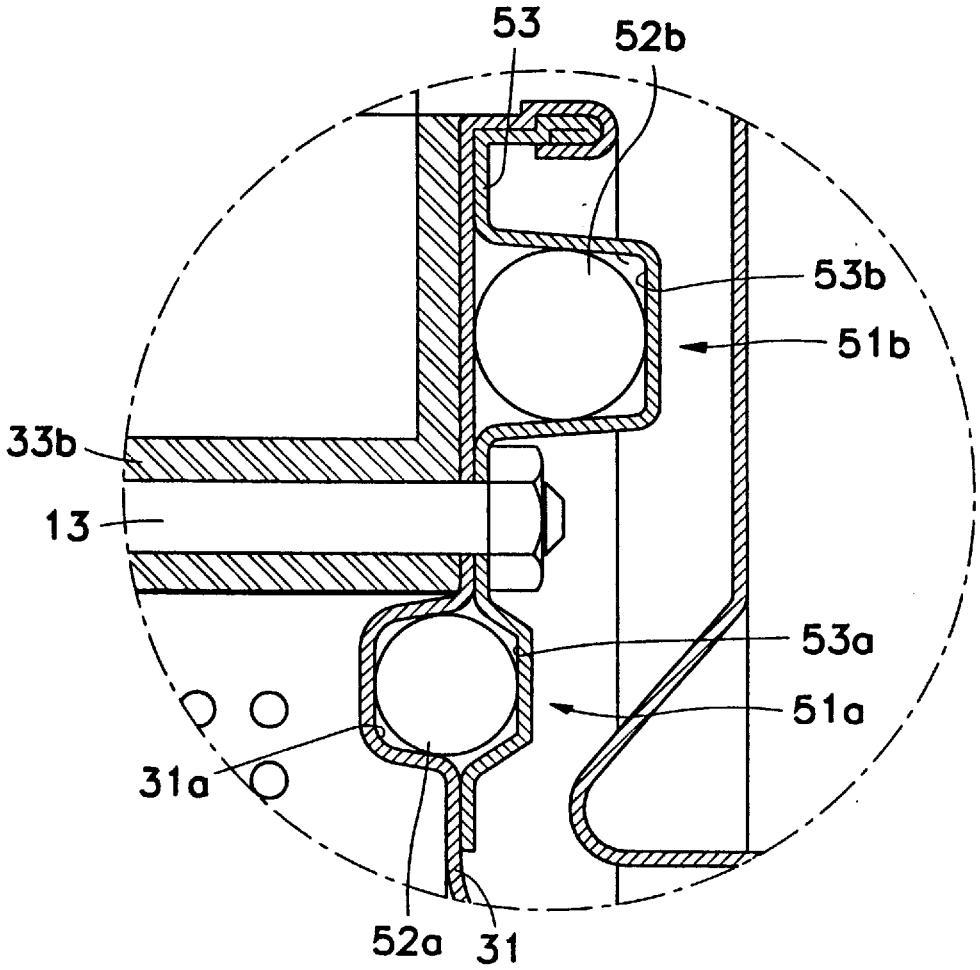
FIG. 2 is an enlarged view of a part of the balancing device of FIG. 1.
Figure 3:
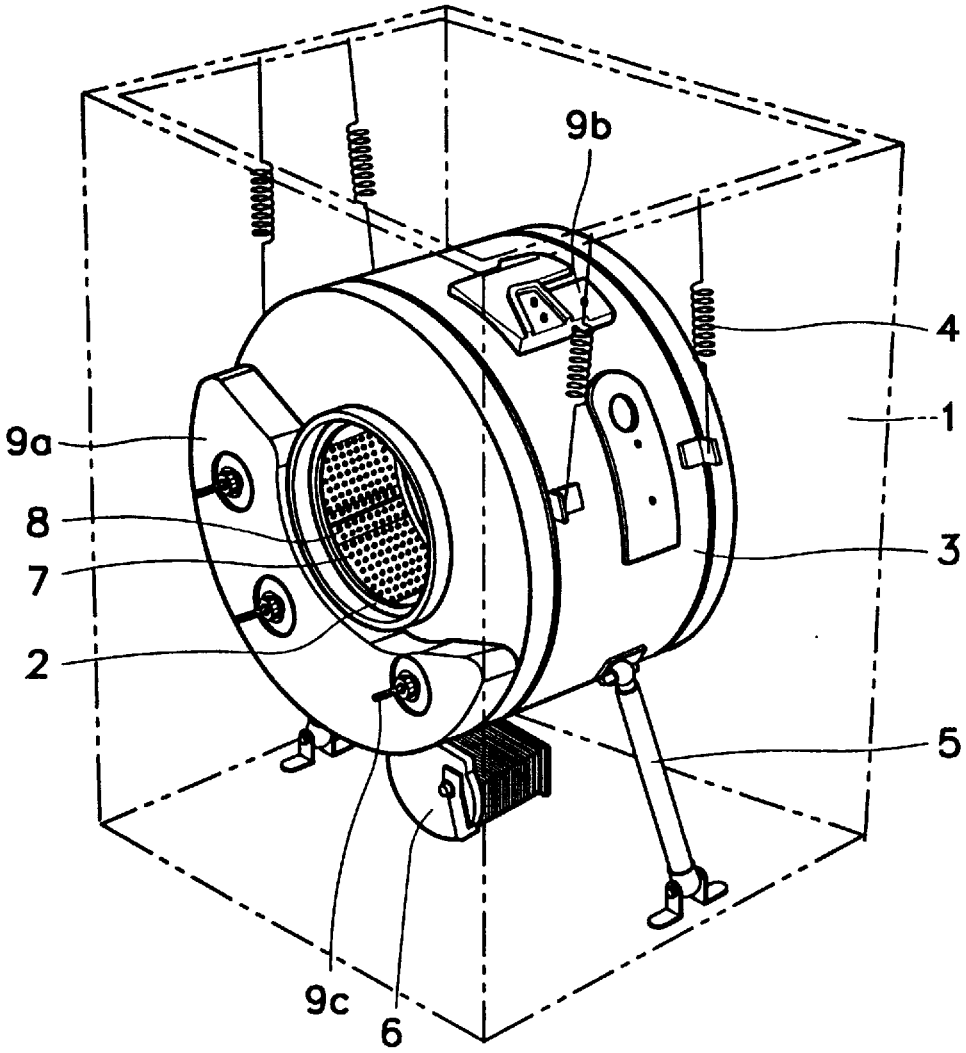
FIG. 3 (PRIOR ART)
FIG. 3 is a perspective view of the overall construction of a conventional drum washing machine.

As shown in FIG. 2, the races 51*a* and 51*b* are constituted of the combination of the front panel 31 and a plate member 53 coupled to the front panel 31. The outer race 51*b* is formed protruding outward for facilitating the manufacturing of the lifter 33*b*. That is, the outer race 51*b* is formed of the combination of the forward-protruding outward groove 53*b*, provided to the plate member 53, and the planar front panel 31. The area of the front panel 31 that contacts the lifter 33*b*'s end portion is designed to be planar to facilitate the manufacturing of the lifter 33*b*, which is formed by bending the side panel 33 inward.

The inner race 51*a*, which does not interfere the lifter 33*b*, is formed of the combination of the outward groove 53*a* on the plate member 53 and an inward groove 31*a* on the front panel 31. Deformation of the spin basket 30 that may occur during manufacturing is prevented by reducing the depth of the inward groove 31*a* and the outward groove 53*a*.

The plate member 53, the front panel 31 and the rear panel 32 that each constitute the races 51*a* and 51*b* are additionally joined to each other by a bolt 13 (refer to FIG. 1).

The following description relates to the operation of the drum washing machine with the balancing device.

When the drum washing machine starts to operate, the electric motor 40 operates according to a prescribed program, in which the spin basket 30 first rotates forward and reverse. The washing process is carried out by the use of the suds generated by the rotation of the spin basket 30, and further created by the action of the lifters 33*b* formed on the side panel 33 of the spin basket 30. The laundry and water are agitated by the lifters 33*b* and the side panel 33.

The water is then removed from the laundry during the hydro-extracting step by centrifugal force as the spin basket 30 rotates at high speeds, and drains into the tub 20 through the holes 33*a* formed on the side panel 33.

The vibrations that are created by the uneven distribution of laundry can be reduced by the following procedure.

The laundry is located on the bottom of the spin basket 30 in the initial stage of the hydro-extracting process. As the spin basket 30 creates centrifugal force by being rotated at high speeds by the electric motor 40, the balls 52*a* and 52*b* are moved to the opposite side of the imbalance along the corresponding races 51*a* and 51*b* by the centrifugal force, thus compensating for the out-of-balance condition of the spin basket 30 and preventing the vibration and eccentric rotation of the spin basket 30.

More specifically, the spin basket 30 turns eccentric from its geometric center due to the laundry being gathered on one spot in the spin basket 30. The centrifugal force from the geometric center and that of its center of rotation simultaneously act on the balls 52*a* and 52*b* seated in the races 51*a* and 51*b*, so that the balls 52*a* and 52*b* relocate to a predetermined position to oppose the imbalance. The balls 52*a* and 52*b* turn about the geometric center of the spin basket 30, thus making the spin basket 30's center of rotation correspond to the geometric center. This counters the unbalanced state of the spin basket 30, and thereby eliminates the vibrations and noise.

As fully described above, the drum washing machine, equipped with the balancing device of the present invention, prevents the spin basket from abnormally rotating by dynamically counteracting imbalances that may occur by the uneven arrangement of laundry therein, and eliminates the vibrations and noise created during rotation. The inventive balancing device may also prevent unnecessary wear of the components used to support the rotation of the spin basket and abnormal noise created by friction.

In addition, the areas of the front and rear panels that contact the lifters are designed to be planar, and, since both ends of the lifters are flat themselves, the manufacturing of the lifters is facilitated.

What is claimed is:

1. A balancing device for a drum washing machine, comprising:

a rotatable spin basket constructed of front and rear panels connected with each other by a side panel;

lifters provided to the side panel that protrude to the inside of the spin basket, each having one end contacting the front panel and the other end contacting the rear panel;

plate members joined to the front and rear panels;

annular races, concentric with the spin basket, formed by outward-protruding outer grooves which are made by the attachment of either of the flat front panel or the flat rear panel to the plate member; and a plurality of balls seated in the races.

2. A balancing device for a drum washing machine according to claim 1, wherein the number of the races is at least two, and one of them is provided to the outside of each of the lifters.

* * * * *